US009052650B2

(12) United States Patent
Yamano et al.

(10) Patent No.: US 9,052,650 B2
(45) Date of Patent: Jun. 9, 2015

(54) FIXING DEVICE AND IMAGE FORMING APPARATUS

(71) Applicants: Motoyoshi Yamano, Tokyo (JP); Jun Okamoto, Kanagawa (JP); Tetsuo Tokuda, Kanagawa (JP); Takashi Sakamaki, Kanagawa (JP); Satoshi Ueno, Tokyo (JP); Naoto Suzuki, Kanagawa (JP); Fumihiro Hirose, Kanagawa (JP)

(72) Inventors: Motoyoshi Yamano, Tokyo (JP); Jun Okamoto, Kanagawa (JP); Tetsuo Tokuda, Kanagawa (JP); Takashi Sakamaki, Kanagawa (JP); Satoshi Ueno, Tokyo (JP); Naoto Suzuki, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 10 days.

(21) Appl. No.: 13/671,082

(22) Filed: Nov. 7, 2012

(65) Prior Publication Data

US 2013/0142551 A1 Jun. 6, 2013

(30) Foreign Application Priority Data

Dec. 5, 2011 (JP) ..... 2011-265466

(51) Int. Cl.
*G03G 15/20* (2006.01)

(52) U.S. Cl.
CPC ..... *G03G 15/2053* (2013.01)

(58) Field of Classification Search
CPC ..... G03G 15/20; G03G 15/2039; G03G 15/2042; G03G 15/2046; G03G 15/2053; G03G 15/2082; G03G 15/2078; G03G 15/2017
USPC ..... 399/328, 334
See application file for complete search history.

(56) References Cited

U.S. PATENT DOCUMENTS

2002/0186991 A1* 12/2002 Watanabe et al. ..... 399/328
2005/0191098 A1 9/2005 Ueno et al.

(Continued)

FOREIGN PATENT DOCUMENTS

JP 2000-030850 1/2000
JP 2001-135470 5/2001

(Continued)

OTHER PUBLICATIONS

P. D. Desai, H. M. James and C. Y. Ho. Electrical Resistivity of Aluminum and Manganese. J. Phys. Chem. Ref. Data, vol. 13, No. 4, 1984. Relevent data is in Table 1, p. 1133.*

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A fixing device fixes a toner image on a recording medium by heating the recording medium, with a heating area and a non-heating area selected in accordance with a magnetic flux and a repulsive magnetic flux. The fixing device includes a heat generating layer, an exciting coil, and a demagnetizing member. The heat generating layer generates heat. The exciting coil generates the magnetic flux, and thereby inductively heats the heat generating layer. The demagnetizing member faces the heat generating layer in the non-heating area. The demagnetizing member generates the repulsive magnetic flux against the magnetic flux generated by the exciting coil, and thereby demagnetizes the magnetic flux and suppresses the heating. Further, the demagnetizing member has a demagnetization effect different between at least a portion of the non-heating area adjacent to the heating area and the remaining portion of the non-heating area.

13 Claims, 8 Drawing Sheets

(56) References Cited

U.S. PATENT DOCUMENTS

2006/0029411 A1 2/2006 Ishii et al.
2006/0289419 A1 12/2006 Ueno
2007/0014600 A1 1/2007 Ishii et al.
2007/0201916 A1 8/2007 Ueno
2007/0264060 A1 11/2007 Ueno et al.
2008/0219721 A1 9/2008 Ito et al.
2008/0226326 A1 9/2008 Seo et al.
2008/0232873 A1 9/2008 Ueno et al.
2009/0245897 A1 10/2009 Seo et al.
2009/0274477 A1 11/2009 Okamoto et al.
2010/0158553 A1 6/2010 Ueno
2010/0303521 A1 12/2010 Ogawa et al.
2011/0026988 A1 2/2011 Yoshikawa et al.
2011/0044734 A1 2/2011 Shimokawa et al.
2011/0052237 A1 3/2011 Yoshikawa et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058865 A1 3/2011 Tokuda et al.
2011/0058866 A1 3/2011 Ishii et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0091253 A1* 4/2011 Seo et al. ..... 399/333
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176822 A1 7/2011 Ishii et al.
2011/0182609 A1 7/2011 Hasegawa et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229162 A1 9/2011 Ogawa et al.
2011/0229178 A1 9/2011 Ogawa et al.
2011/0229181 A1 9/2011 Iwaya et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.
2012/0237274 A1 9/2012 Okamoto
2012/0275809 A1* 11/2012 Paik ..... 399/69

FOREIGN PATENT DOCUMENTS

JP 2008-102403 5/2008
JP 2009-230070 10/2009

OTHER PUBLICATIONS

U.S. Appl. No. 13/557,841, filed Jul. 25, 2012, Toshihiko Shimokawa, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2011-265466, filed on Dec. 5, 2011, in the Japan Patent Office, the entire disclosure of which is hereby incorporated by reference herein.

BACKGROUND OF THE INVENTION

1. Field of the Invention

The present invention relates to a fixing device employing an electromagnetic induction heating method used in an image forming apparatus such as a copier, a printer, a facsimile machine, a printing machine, and a multifunction machine combining several of the functions of these apparatuses, and to an image forming apparatus using the fixing device. More specifically, the present invention relates to a mechanism for setting a fixing area according to sheet size.

2. Description of the Related Art

In an electrophotographic image forming apparatus, a toner image transferred to a recording medium, such as a recording sheet, from an image carrier, such as a photoconductor, is fixed on the recording medium by the action of fusion and penetration with heat and pressure, and thereby a copy is obtained.

Heating methods employed in the fixing device include an electromagnetic induction heating method. Unlike a commonly used heat roller fixing method, the electromagnetic induction heating method is advantageous in that the method does not require a heating mechanism, such as a heating roller, and is capable of generating heat by using an eddy current generated in a member used in the fixing process, such as a fixing roller or a belt, i.e., is capable of using the fixing member as a heating source and thus reducing the time taken to raise the temperature.

According to the electromagnetic induction heating method, however, it is difficult, in some cases, to equalize temperature distribution in the latitudinal direction of the fixing roller or the width direction of the belt owing to the relative thinness of an electromagnetic induction heat generating layer serving as a heat generating member. That is, if the recording sheet serving as the recording medium is fed in, for example, a width center alignment method in the latitudinal direction of the fixing roller or the width direction of the belt, heat loss and reduction in temperature occur in a sheet passing area corresponding to a central portion in the width direction of the recording sheet, while the heat loss and the resultant reduction in temperature are suppressed in sheet non-passing areas (i.e., areas of the fixing roller or belt outside the sheet, and over which the sheet does not pass) corresponding to opposite lateral end portions in the width direction.

In addition, recording sheets come in various standard sizes, such as A-series sizes and B-series sizes according to Japan Industrial Standards (JIS), for example. Further, in sheet feeding, the longitudinal direction parallel to the sheet feeding direction may be different between recording sheets of the same size. Due to the presence of the sheet passing area and the sheet non-passing areas, therefore, unevenness in temperature tends to occur in the latitudinal direction of the fixing roller or the width direction of the belt. Specifically, if a large-sized recording sheet is fed immediately after continuous feeding of small-sized recording sheets, the temperature distribution may be uneven in the width direction of the large-sized recording sheet and thereby adversely affect, for example, the glossiness of the image.

As a configuration addressing the unevenness in temperature in the latitudinal direction of the fixing roller or the width direction of the belt, a background heating mechanism includes a demagnetizing member which changes the influence of magnetic flux in the electromagnetic induction heating method. As well as an exciting coil which performs electromagnetic induction heating, a secondary demagnetizing coil is provided at each of positions corresponding to the sheet non-passing areas such that induced electromotive force and induced current of the secondary demagnetizing coil, which are generated by a change in magnetic flux generated by the exciting coil, reduce the magnetic flux in the sheet non-passing areas and thereby prevent an excessive increase in temperature.

Another background heating mechanism has a configuration including a metal plate and a magnetic shunt alloy having a characteristic of switching between magnetic and non-magnetic states at a Curie temperature. The magnetic shunt alloy is disposed between the metal plate and an exciting coil to allow a magnetic flux to pass through the magnetic shunt alloy into the metal plate when the temperature of the magnetic shunt alloy reaches or exceeds the Curie temperature. Thereby, a repulsive magnetic flux against the magnetic flux of the exciting coil is generated in the metal plate, cancelling out an induced magnetic flux generated by the exciting coil to provide a built-in temperature control capability.

Still another background heating mechanism has a configuration which includes magnetic flux cancellation coils facing the sheet non-passing areas, and which controls power supply to the magnetic flux cancellation coils to prevent an excessive increase in temperature in the sheet non-passing areas.

In the configurations of the background heating mechanisms, the following issue arises owing to a relatively wide thermal boundary between the sheet passing area and each of the sheet non-passing areas. Thermal boundary width refers to the space between an end portion of a heating area and an end portion of a non-heating area obtained in accordance with the overlapping position of the exciting coil and the demagnetizing cancellation coil at the boundary between the sheet passing area and the sheet non-passing area.

If the space between the end portion of the heating area and the end portion of the non-heating area is increased, the sheet non-passing area, which is not required to be heated, is also heated and increased in temperature. This results in an increase in energy loss, and may cause degradation of the fixing member due to the excessive increase in temperature.

Meanwhile, if the exciting coil and the demagnetizing cancellation coil excessively overlap each other between the end portion of the heating area and the end portion of the non-heating area, a portion of the sheet passing area adjacent to the sheet non-passing area is reduced in temperature when the demagnetizing cancellation coil is operated. As a result, unevenness in temperature occurs in the entire sheet passing area, and may cause phenomena such as a fixing failure and uneven glossiness of the image. Such phenomena occur in the configurations of the foregoing background heating mechanisms.

SUMMARY OF THE INVENTION

The present invention describes a novel fixing device. In one example, a novel fixing device fixes a toner image on a recording medium by heating the recording medium, with a heating area and a non-heating area selected in accordance with a magnetic flux and a repulsive magnetic flux. The fixing device includes a heat generating layer, an exciting coil, and a demagnetizing member. The heat generating layer is configured to generate heat. The exciting coil is configured to generate the magnetic flux and thereby inductively heat the heat generating layer. The demagnetizing member faces the heat generating layer in the non-heating area. Further, the demagnetizing member is configured to generate the repulsive magnetic flux against the magnetic flux generated by the exciting coil, to thereby demagnetize the magnetic flux and suppress the heating. Further, the demagnetizing member is configured to have a different demagnetization effect between at least a portion of the non-heating area adjacent to the heating area and the remaining portion of the non-heating area.

In the fixing device, a distance between the demagnetizing member and exciting coil, which face each other, may be different between at least the portion of the non-heating area adjacent to the heating area and the remaining portion of the non-heating area.

In the fixing device, the demagnetizing member may include a cancellation coil which generates a magnetic flux in a direction of canceling the magnetic flux of the exciting coil, and which is located closer to the exciting coil in the portion of the non-heating area adjacent to the heating area than in the remaining portion of the non-heating area.

In the fixing device, the demagnetizing member may have an end portion located at the position of the boundary between the heating area and the non-heating area.

In the fixing device, the demagnetizing member may include a metal plate having a portion of increased thickness in the portion of the non-heating area adjacent to the heating area.

In the fixing device, the demagnetizing member may include a metal plate having a portion of enlarged area in the area facing the exciting coil.

In the fixing device, the demagnetizing member may include a metal plate having portions of different electrical resistances.

In the fixing device, the metal plate forming the demagnetizing member may have a portion plated with a material having relatively low electrical resistance.

In the fixing device, the demagnetizing member may include a metal plate provided with one of a hole and a groove in the non-heating area.

In the fixing device, the demagnetizing member may include a metal plate having a portion located adjacent to the exciting coil.

In the fixing device, the demagnetizing member may include an aluminum plate.

The present invention further describes a novel image forming apparatus. In one example, a novel image forming apparatus includes an image forming unit configured to form a toner image on a recording medium, and the above-described fixing device having the heat generating layer provided in one of a fixing roller, a fixing sleeve, and a fixing belt.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
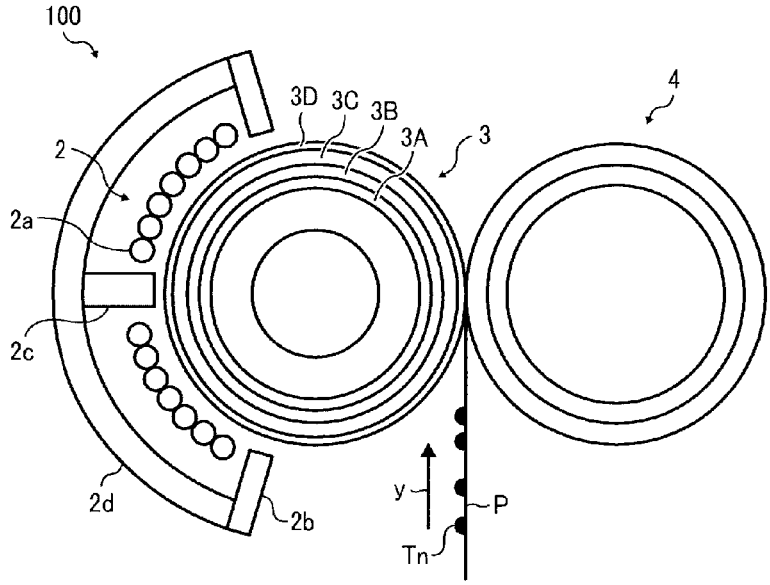
FIG. 1 is a schematic diagram illustrating a configuration of a fixing device using a heating mechanism according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Figure 2:
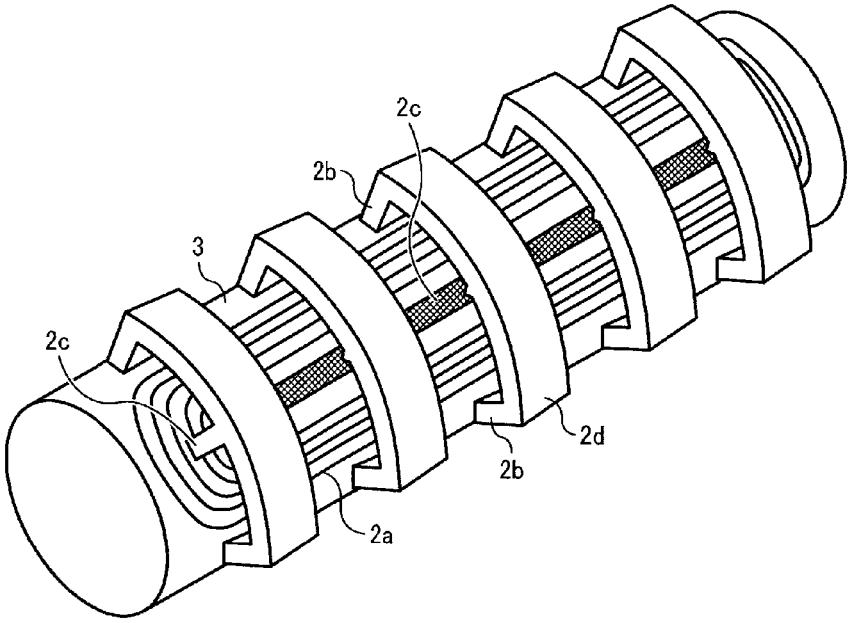
FIG. 2 is an external view of the configuration illustrated in FIG. 1.

Referring now to the drawings, wherein like reference numerals designate identical or corresponding parts throughout the several views, embodiments of the present invention will be described. With reference to FIGS. 1 and 2, description will first be made of a configuration of main components of a fixing device according to a heat roller fixing method used in an image forming apparatus. FIGS. 1 and 2 illustrate a configuration including a metal plate as a demagnetizing member. FIG. 1 illustrates a fixing roller 3, a pressure roller 4, and a heating mechanism 100 including a magnetic flux generator 2. In FIG. 1, the heat-generating fixing roller 3 faces and presses against the pressure roller 4. The outer circumferential surface of the fixing roller 3 facing and in contact with the pressure roller 4 rotates in a direction of moving a recording sheet (i.e., recording medium) P in a recording sheet feeding direction indicated by arrow y. In the vicinity of the outer circumferential surface of the fixing roller 3, the magnetic flux generator 2 forming a main component of the heating mechanism 100 is fixed to the not-illustrated body of the fixing device.

The magnetic flux generator 2 included in the heating mechanism 100 includes arch cores 2*d* and an exciting coil 2*a*. Each of the arch cores 2*d* includes a center core 2*c* and leg cores 2*b* respectively forming a central portion and opposed end portions of the arch core 2*d*. The exciting coil 2*a* is a substantially flat coil located between the arch cores 2*d* and the fixing roller 3 and wound around the center core 2*c*, as illustrated in FIG. 2.

The illustrated fixing device generates a high-frequency magnetic field (i.e., magnetic flux) by high-frequency driving of the exciting coil 2*a* of the magnetic flux generator 2 with the use of a not-illustrated inverter drive source. The magnetic field causes an eddy current to flow through the fixing roller 3 mainly made of metal, and thereby increases the temperature of the fixing roller 3. The recording sheet P carrying thereon toner Tn passes between the fixing roller 3 and the pressure roller 4 such that a surface of the recording sheet P with the toner Tn comes into contact with the fixing roller 3. During the passage, the toner Tn is fixed on the recording sheet P with heat and pressure applied thereto.

As illustrated in FIG. 1, the fixing roller 3 includes a core bar demagnetizing member 3A located at the innermost position, a not-illustrated heat-insulating layer formed by an air-space or a foam layer provided on the outer circumferential surface of the demagnetizing member 3A, a magnetic shunt alloy 3B, a not-illustrated antioxidant layer, a heat generating layer 3C, a not-illustrated antioxidant layer, a not-illustrated elastic layer, and a release layer 3D forming an outer surface layer of the fixing roller 3.

The demagnetizing member 3A is formed by a cancellation coil serving as a demagnetizing coil or by a metal plate containing, for example, aluminum or an alloy thereof, as described above with reference to FIG. 1. The cancellation coil is also applicable to later-described cancellation coils 2*e*. As the magnetic shunt alloy 3B, any known appropriate magnetic shunt alloy is used. The antioxidant layers are formed by nickel strike plating. The heat generating layer 3C is formed by Cu plating. The elastic layer is made of silicone rubber. The release layer 3D is made of tetrafluoroethylene-perfluoroalkyl vinyl ether copolymer (PFA).

The magnetic shunt alloy 3B is a magnetic material, such as a magnetic shunt alloy material containing iron and nickel, for example, which is formed to have a Curie temperature ranging, for example, from approximately 100 degrees Celsius to approximately 300 degrees Celsius. Further, the magnetic shunt alloy 3B is maintained at a position between the exciting coil 2*a* and the demagnetizing member 3A, and is configured to be pressed and deformed by the pressure roller 4 to form a nip. The presence of the magnetic shunt alloy 3B prevents overheating of components such as the heat generating layer 3C. Details of the configuration of the above-described fixing roller 3 are disclosed in Japanese Laid-Open Patent Application No. 2009-58829, which is an earlier application of the present applicant.

Figure 3:
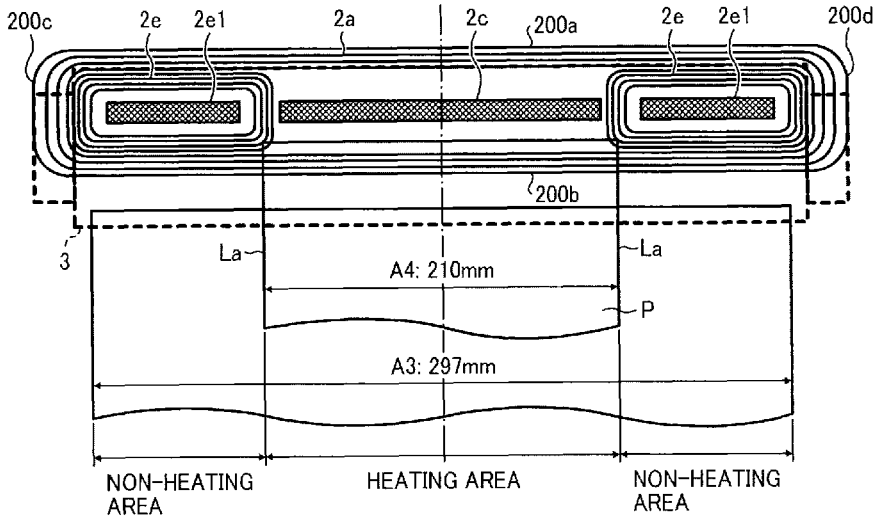
FIG. 3 is a plan view illustrating a configuration of main components of the heating mechanism used in the fixing device illustrated in FIG. 1.

The configuration of the heating mechanism 100 will now be described with reference to FIG. 3. FIG. 3 is a plan view illustrating the configuration of the heating mechanism 100 used in the fixing device illustrated in FIG. 1. The exciting coil 2*a* included in the heating mechanism 100 includes folded-back opposed end portions 200*c* and 200*d* and elongated portions 200*a* and 200*b* leading to the opposed end portions 200*c* and 200*d*. Each of the elongated portions 200*a* and 200*b* has a length sufficient to cover the entire area in the width direction of a large-sized recording sheet to be subjected to the fixing process, i.e., an A3-size recording sheet having a width of approximately 297 mm in this case.

Inside the elongated portions 200*a* and 200*b* of the exciting coil 2*a*, the cancellation coils 2*e* serving as demagnetizing coils are disposed on opposite sides relative to the center in the width direction of the recording sheet, i.e., relative to the position indicated by a broken line in FIG. 3. The cancellation coils 2*e* are disposed in respective areas outside opposed end portions in the width direction of a small-sized recording sheet, i.e., an A4-size recording sheet having a width of approximately 210 mm in this case, which is smaller than the heating area of the large-sized recording sheet corresponding to the elongated portions 200*a* and 200*b* of the exciting coil 2*a*. Each of the cancellation coils 2*e* includes folded-back opposed end portions and elongated portions leading to the opposed end portions. One of the opposed end portions of the cancellation coil 2*e* is located at the position of the corresponding end portion in the width direction of the small-sized recording sheet, i.e., the position indicated by a solid line La in FIG. 3. Accordingly, the cancellation coil 2*e* is disposed in a non-heating area of the small-sized recording sheet.

The folded-back end portion is positioned such that an outermost layer of the multiply wound cancellation coil 2*e* corresponds to the end portion in the width direction of the small-sized recording sheet, or that a plurality of layers of the cancellation coil 2*e* are laid across the end portion in the width direction of the small-sized recording sheet.

Figure 4:
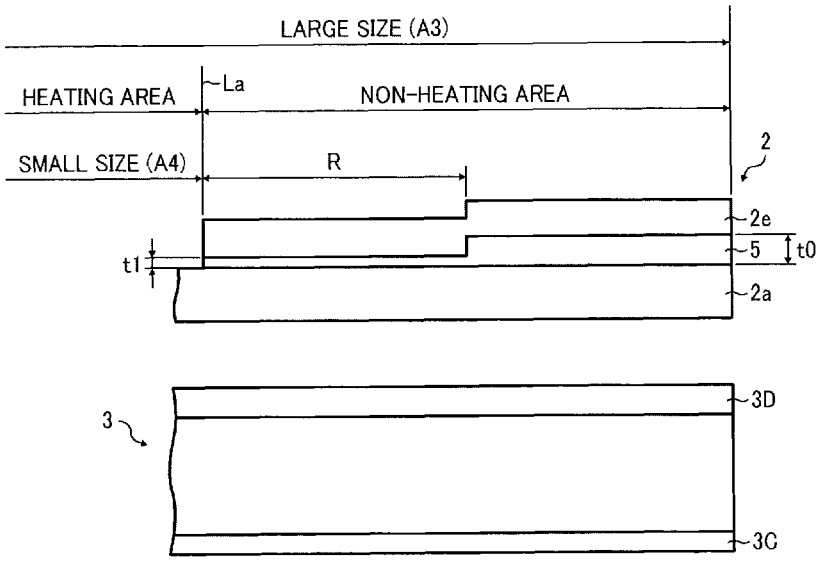
FIG. 4 is a cross-sectional view illustrating a part of the configuration of the main components illustrated in FIG. 3.

FIG. 4 is a cross-sectional view illustrating a part of the configuration of the heating mechanism 100 illustrated in FIG. 3 and the fixing roller 3 facing the heating mechanism 100. In FIG. 4, the exciting coil 2*a* faces the fixing roller 3, and the cancellation coil 2*e* is laminated on the exciting coil 2*a* via an insulator 5. As described above, the fixing roller 3 includes lamination of the release layer 3D forming the outer surface layer and made of PFA set to a thickness of approximately 10 μm, the elastic layer provided inside the release layer 3D and made of a silicone rubber having a thickness of approximately 200 μm, and the heat generating layer 3C formed by a Cu layer having a thickness of approximately 20 μm. When the magnetic flux of the exciting coil 2*a* reaches the heat generating layer 3C, an eddy current is generated and heats the fixing roller 3.

The present embodiment is configured such that the demagnetization effect of a demagnetizing member in the non-heating area is different between a portion adjacent to the corresponding end portion in the width direction of the small-sized recording sheet and the remaining portion.

As an example of this configuration, if each of the cancellation coils 2*e* corresponding to the demagnetizing coil is used as the demagnetizing member, the gap between the cancellation coil 2*e* and the exciting coil 2*a* facing each other is changed. That is, in the non-heating area of FIG. 4, the gap between the cancellation coil 2*e* and the exciting coil 2*a* is reduced at a portion adjacent to the heating area, as compared with the remaining portion.

According to the present configuration, as indicated by thicknesses t0 and t1 in FIG. 4, the insulator 5 located between the cancellation coil 2*e* and the exciting coil 2*a* is reduced in thickness in a portion corresponding to an area R adjacent to the heating area such that the portion is thinner than the remaining portion, i.e., the thickness t1 is less than the thickness t0. Thereby, the portion of the cancellation coil 2*e* adjacent to the heating area is located closer to the exciting coil 2*a* than the remaining portion of the cancellation coil 2*e* is.

Figure 5:
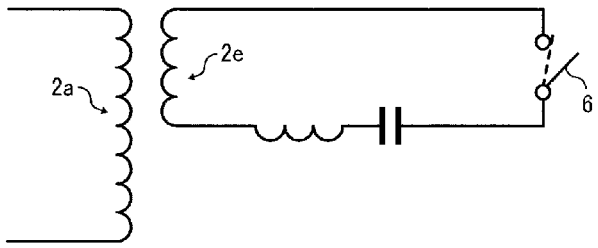
FIG. 5 is a circuit diagram illustrating a control circuit used in the main components illustrated in FIG. 3.

The cancellation coil 2*e* is connected to a control circuit illustrated in FIG. 5 to be drive-controlled. Specifically, a switch 6 is used to turn ON and OFF the power supply to the cancellation coil 2*e*. To heat the large-sized recording sheet, the switch 6 is maintained in the open state, i.e., the OFF state. To heat the small-sized recording sheet, the switch 6 is closed, as indicated by a broken line in FIG. 5, to be set in a so-called ON state. Thereby, power is supplied to the cancellation coil 2*e*. When power is supplied to the cancellation coil 2*e*, a repulsive magnetic field against the magnetic field of the exciting coil 2*a* is generated in the non-heating area. Thereby, the magnetic flux of the exciting coil 2*a* is cancelled, and an overheated state of the heat generating layer 3C is prevented.

In the present example, the gap between the exciting coil 2*a* and the cancellation coil 2*e* used as the demagnetizing coil is changed. Specifically, the cancellation coil 2*e* is located closer to the exciting coil 2*a* in a portion adjacent to the boundary between the non-heating area and the heating area corresponding to an end portion in the width direction of the small-sized recording sheet than in the remaining portion. Accordingly, the repulsive magnetic flux of the cancellation coil 2*e* against the magnetic flux generated in the exciting coil 2*a* acts more effectively on the side of the end portion in the width direction of the small-sized recording sheet.

Figure 6:
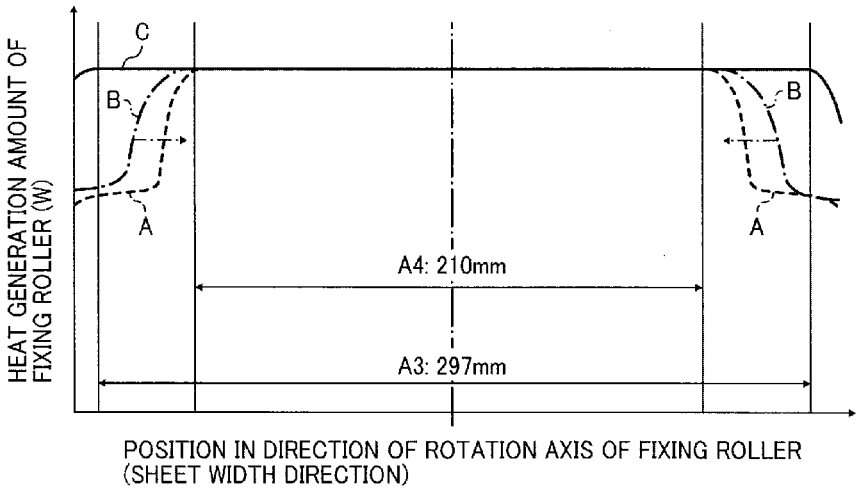
FIG. 6 is diagram illustrating the operation of the configuration of the main components illustrated in FIG. 3.

FIG. 6 is a diagram illustrating changes in temperature in the non-heating areas in a case using the configuration illustrated in FIG. 4 and a case using a configuration having a uniform gap between the exciting coil 2*a* and each of the cancellation coils 2*e* used as the demagnetizing coil. In FIG. 6, a line A indicates changes in temperature in the non-heating areas of the small-sized recording sheet (i.e., A4) in the configuration of FIG. 4, and a line B indicates changes in temperature in the non-heating areas of the small-sized recording sheet in the configuration having the uniform gap. A line C indicates changes in temperature in the non-heating areas of the large-sized recording sheet (i.e., A3). It is observed from FIG. 6 that, in the configuration illustrated in FIG. 4, a reduction in temperature starts in respective areas corresponding to the reduced gap between the exciting coil 2*a* and the cancellation coil 2*e*, i.e., at respective portions adjacent to the end portions in the width direction of the small-sized recording sheet, as compared with the configuration having the uniform gap.

Accordingly, with a relatively simple configuration which changes the gap between the exciting coil 2*a* and the cancellation coil 2*e*, an excessive increase in temperature in the non-heating area is prevented in the portion of the non-heating area adjacent to the boundary between the heating area and the non-heating area. Further, since the reduction in temperature starts near the boundary, the temperature is increased in the entire heating area leading to the boundary, and a reduction in temperature in an end portion of the heating area near the boundary is prevented. Consequently, unevenness in temperature is suppressed.

The configuration which controls the power supply to the demagnetizing coil in the non-heating area and thereby generates a magnetic field for canceling the magnetic field generated by the exciting coil is disclosed in, for example, Japanese Laid-Open Patent Application No. 2005-321642. The disclosed configuration, however, is based on the assumption that the gap between the exciting coil and the demagnetizing coil is uniform. The disclosed configuration is therefore different from the configuration of the present example which sets, in the heating of the small-sized recording sheet, the demagnetization starting area to be adjacent to an end portion in the width direction of the small-sized recording sheet, to thereby prevent an increase in temperature in the portion adjacent to the end portion in the width direction of the small-sized recording sheet.

As described above, according to the present example, with the relatively simple configuration which changes the gap between the exciting coil 2*a* and the cancellation coil 2*e* in the non-heating area, heating in the non-heating area is suppressed in the portion adjacent to the boundary between the heating area and the non-heating area. Therefore, a so-called thermal boundary width between the heating area and the non-heating area, i.e., the portion of the non-heating area affected by the heating action is reduced. Consequently, an excessive increase in temperature is prevented in a relatively large portion of the non-heating area.

Description will now be made of another embodiment which adjusts the demagnetization effect in the non-heating area to be different between the portion adjacent to the end portion in the width direction of the small-sized recording sheet and the remaining portion.

Figure 7:
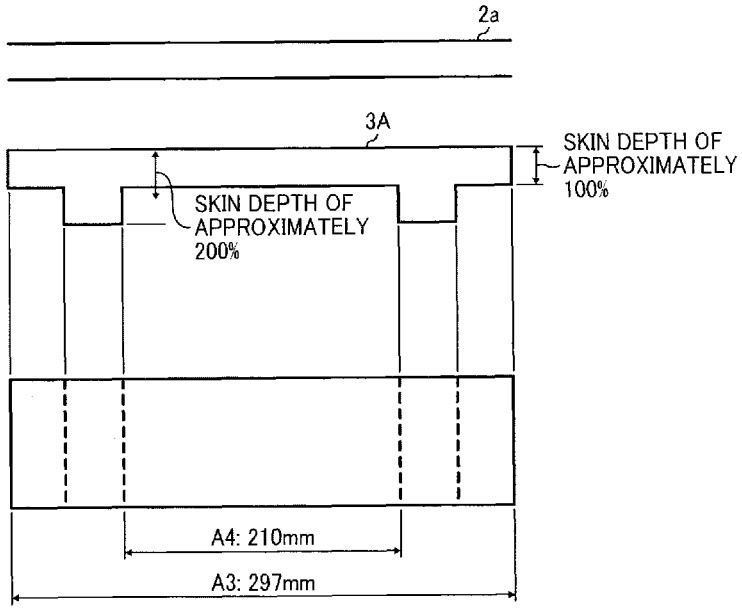
FIG. 7 is a diagram illustrating a modified example of the main components of the heating mechanism illustrated in FIG. 3.

FIG. 7 is a diagram illustrating an example in which the demagnetizing member 3A is formed by the metal plate described above with reference to the fixing device illustrated in FIG. 1. In FIG. 7, the demagnetizing member 3A is increased in thickness in respective portions adjacent to the boundaries between the heating area and the non-heating areas, which correspond to the end portions in the width direction of the small-sized recording sheet, such that the adjacent portions are thicker than the remaining portions. Specifically, the skin depth of the portions of the demagnetizing member 3A adjacent to the boundaries corresponds to a thickness of approximately 200%, when the skin depth of the remaining portions is represented as a thickness of approximately 100%.

According to the present embodiment, in the adjacent portions increased in thickness corresponding to skin depth, the magnetic flux of the exciting coil 2*a* reaches the demagnetizing member 3A in accordance with the increase in temperature owing to the characteristic of the magnetic shunt alloy 3B, and an eddy current is generated on the surface of the demagnetizing member 3A. Due to the increase in cross-sectional area, the skin resistance of the adjacent portions is approximately 2.7 times lower than the skin resistance of the remaining portions. In the adjacent portions, therefore, the eddy current density is increased, and the demagnetization effect is enhanced.

Figure 8:
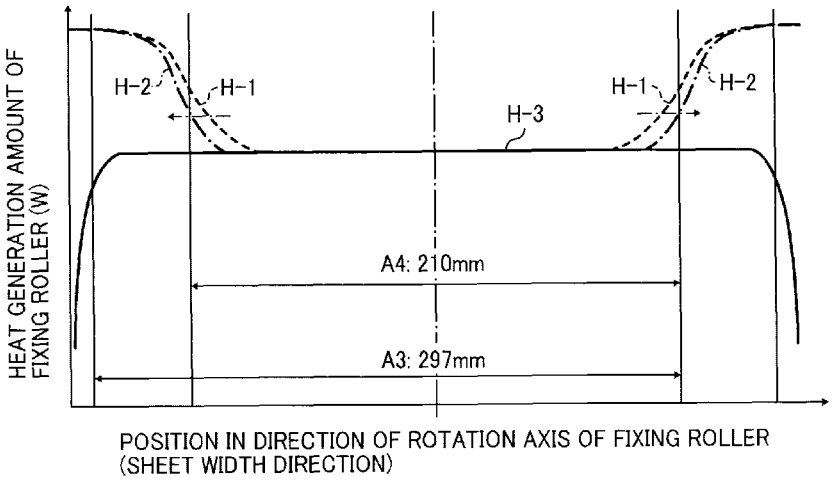
FIG. 8 is diagram illustrating the operation of the modified example illustrated in FIG. 7.

FIG. 8 is a diagram illustrating changes in temperature in a case using the configuration illustrated in FIG. 7 and a case not using the configuration. In FIG. 8, a line H-2 indicates changes in temperature in the non-heating areas of the small-sized recording sheet (i.e., A4) in the case using the configuration illustrated in FIG. 7, and a broken line H-1 indicates changes in temperature in the non-heating areas of the small-sized recording sheet in the case not using the configuration. A line H-3 indicates changes in temperature in the non-heating areas of the large-sized recording sheet (i.e., A3). When the temperature of the magnetic shunt alloy 3B rises and reaches the Curie temperature, the magnetic flux of the exciting coil 2*a* reaches the demagnetizing member 3A, and an eddy current is generated. In this process, the eddy current density is higher in the respective portions adjacent to the end portions in the width direction of the small-sized recording sheet, which correspond to the boundaries between the heating area and the non-heating areas, than in the remaining portions. Therefore, the demagnetization effect is enhanced in the respective portions adjacent to the end portions in the width direction of the small-sized recording sheet. Consequently, the configuration illustrated in FIG. 7 suppresses the unevenness in temperature in the heating area, unlike the other configuration in which the temperature starts to change at respective positions closer to the center of the heating area and more distant from the boundaries between the heating area and the non-heating areas.

Figure 9:
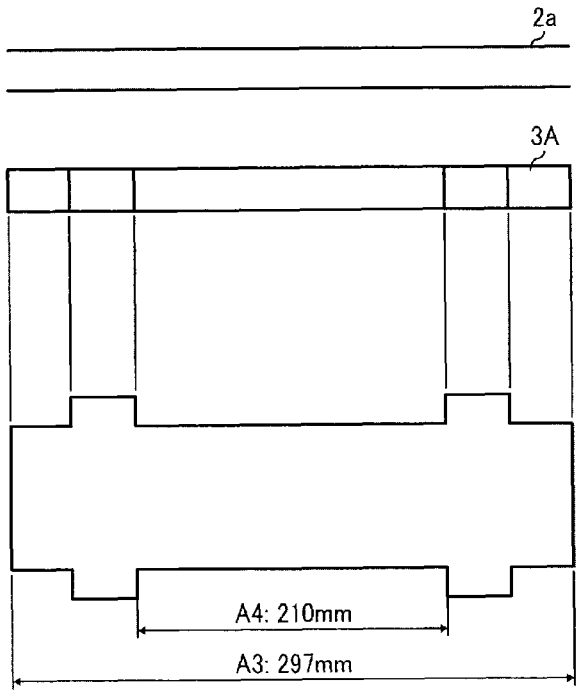
FIG. 9 is a diagram illustrating another modified example of the main components of the heating mechanism illustrated in FIG. 3.

Description will now be made of a modified example of the configuration which changes the demagnetization effect within the demagnetizing member 3A. FIG. 9 is a diagram relating to the area of the demagnetizing member 3A, and illustrates a configuration in which the area of the demagnetizing member 3A is increased in the respective portions adjacent to the end portions in the width direction of the small-sized recording sheet such that the adjacent portions are larger in area than the remaining portions. Each of FIGS. 9 to 13 illustrates a front view of the demagnetizing member 3A on the upper side thereof and a plan view of the demagnetizing member 3A on the lower side thereof. In the configuration illustrated in FIG. 9, the area of the demagnetizing member 3A facing the exciting coil 2*a* is increased in the respective portions adjacent to the end portions in the width direction of the small-sized recording sheet. In the adjacent portions, therefore, the area reached by the magnetic flux of the exciting coil 2*a* is increased, and a larger amount of repulsive magnetic flux is generated to cancel the magnetic flux of the exciting coil 2*a*. Consequently, a result similar to the result illustrated in FIG. 8 is obtained.

Figure 10:
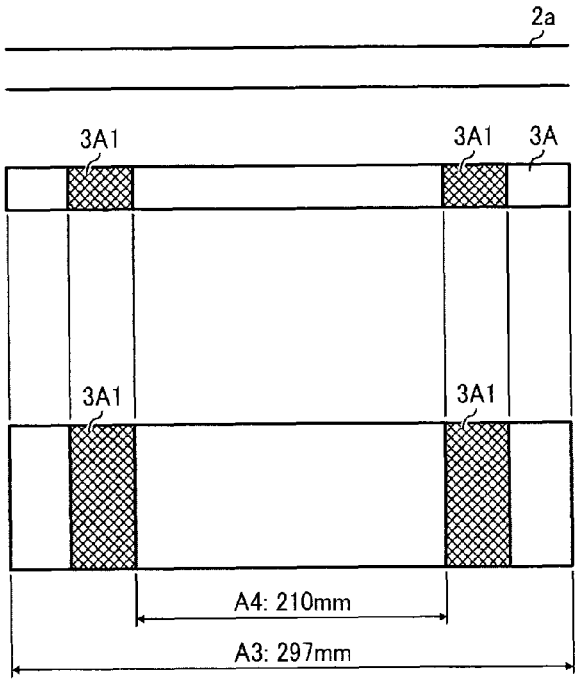
FIG. 10 is a diagram illustrating another modified example of the main components of the heating mechanism illustrated in FIG. 3.

FIG. 10 illustrates a configuration for reducing the electrical resistance of the metal plate forming the demagnetizing member 3A in the respective portions adjacent to the end portions in the width direction of the small-sized recording sheet such that the electrical resistance is lower in the adjacent portions than in the remaining portions. That is, the respective portions of the demagnetizing member 3A adjacent to the end portions in the width direction of the small-sized recording sheet, i.e., portions 3A1 in FIG. 10 are made of a material lower in electrical resistance than a material forming the remaining portions.

In the present configuration, the electrical resistance of the demagnetizing member 3A is lower in the respective portions adjacent to the end portions in the width direction of the small-sized recording sheet than in the remaining portions. In the adjacent portions, therefore, the eddy current density is increased, and the demagnetization effect is enhanced to make it easy to cancel and the magnetic flux of the exciting coil 2*a*. Consequently, a result similar to the result illustrated in FIG. 8 is obtained.

Figure 11:
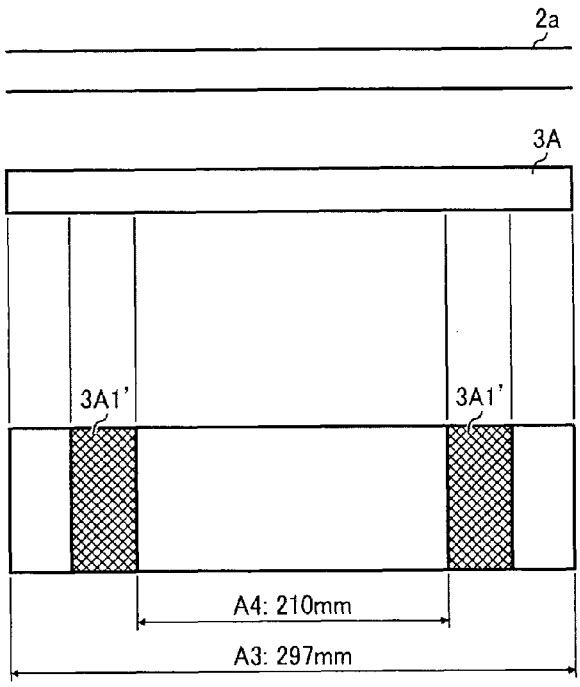
FIG. 11 is a diagram illustrating another modified example of the main components of the heating mechanism illustrated in FIG. 3.

FIG. 11 illustrates a modified example of the configuration illustrated in FIG. 10. To reduce the electrical resistance, the respective portions of the demagnetizing member 3A adjacent to the end portions in the width direction of the small-sized recording sheet, i.e., portions 3A1' in FIG. 11 are plated with a material having relatively low electrical resistance.

Figure 12:
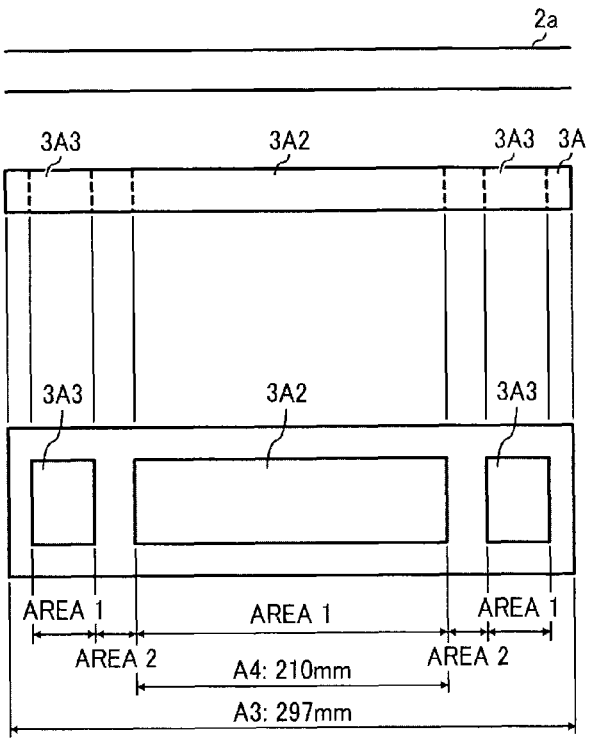
FIG. 12 is a diagram illustrating another modified example of the main components of the heating mechanism illustrated in FIG. 3.

FIG. 12 illustrates a configuration intended to increase the magnetic flux density in the respective portions of the demagnetizing member 3A adjacent to the end portions in the width direction of the small-sized recording sheet. That is, the demagnetizing member 3A is provided with holes 3A2 and 3A3 passing through the demagnetizing member 3A in the thickness direction except for the portions adjacent to the end portions in the width direction of the small-sized recording sheet.

In the present configuration, a flow path of the eddy current is blocked in the areas provided with the holes 3A2 and 3A3, i.e., the portions indicated as AREA 1 in FIG. 12. Thus, the eddy current concentrates on the portions not provided with the holes 3A2 and 3A3. Accordingly, the flow path of the eddy current is secured in the areas not provided with the holes 3A2 and 3A3, i.e., the portions indicated as AREA 2 in FIG. 12. In the portions indicated as AREA 2, therefore, the current density is increased, and the demagnetization effect is enhanced. Consequently, a result similar to the result illustrated in FIG. 8 is obtained.

Figure 13:
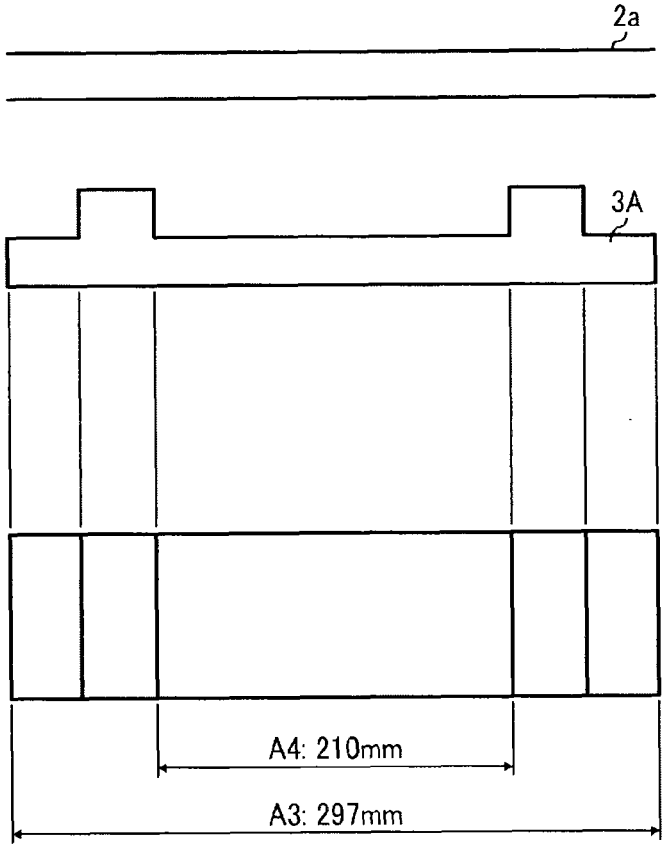
FIG. 13 is a diagram illustrating another modified example of the main components of the heating mechanism illustrated in FIG. 3.

FIG. 13 illustrates a configuration in which the gap between the metal plate forming the demagnetizing member 3A and the exciting coil 2*a* is reduced in the respective portions adjacent to the end portions in the width direction of the small-sized recording sheet corresponding to the boundaries between the heating area and the non-heating areas. In the adjacent portions, therefore, the metal plate is located adjacent to the exciting coil 2*a*.

In the present configuration, the magnetic flux reaching from the exciting coil 2*a* is increased in intensity in the respective portions adjacent to the exciting coil 2*a*. In the respective portions, therefore, the eddy current density is also increased. Accordingly, the demagnetization effect is more enhanced in the respective portions adjacent to the end portions in the width direction of the small-sized recording sheet than in the remaining portions. Consequently, a result similar to the result illustrated in FIG. 8 is obtained.

In the configurations described above, the demagnetization effect is enhanced in the respective portions adjacent to the end portions in the width direction of the small-sized recording sheet corresponding to the boundaries between the heating area and the non-heating areas. As illustrated in FIG. 8, therefore, the unevenness in temperature is suppressed in the entire heating area including the end portions thereof corresponding to the end portions in the width direction of the small-sized recording sheet.

Figure 14:
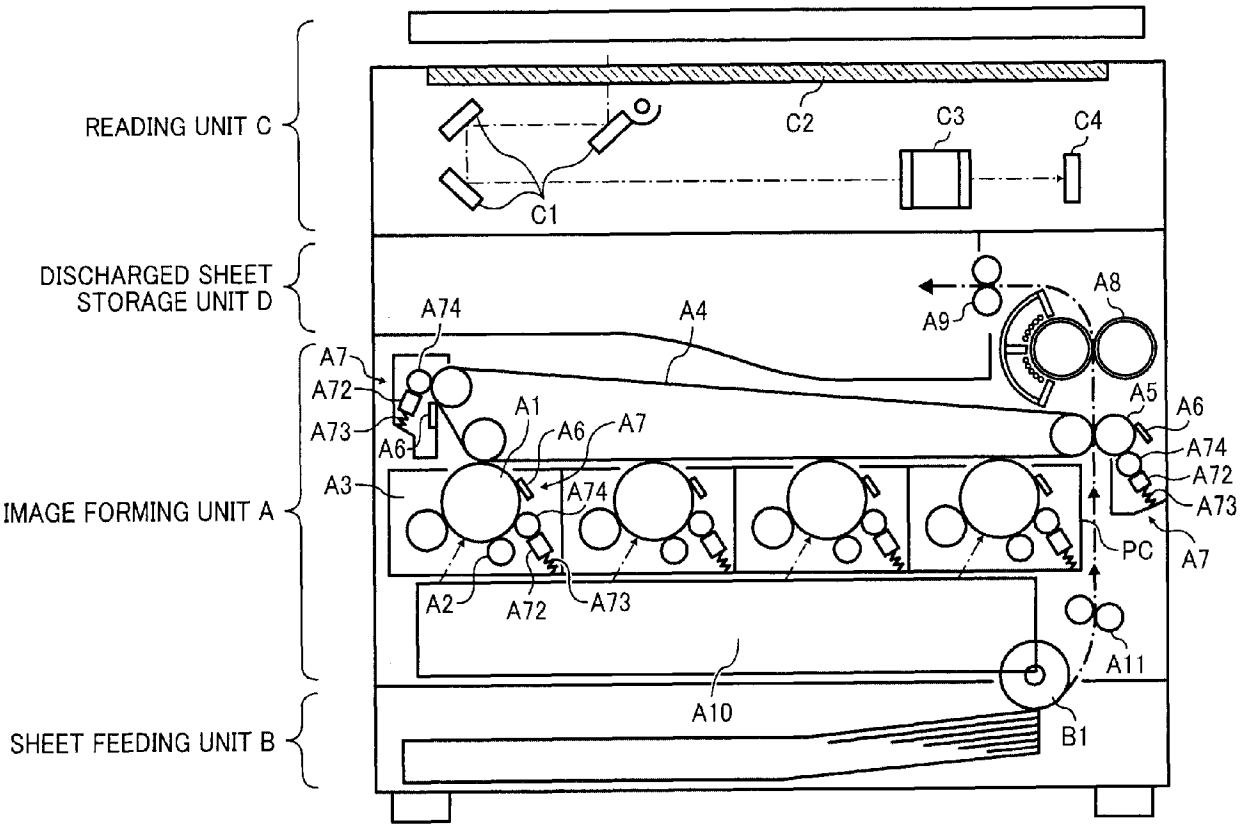
FIG. 14 is a diagram illustrating an image forming apparatus according to an embodiment of the present invention using the fixing device.

The fixing device having one of the above-described configurations is used in an image forming apparatus illustrated in FIG. 14. The configuration of the image forming apparatus will now be described with reference to FIG. 14. FIG. 14 illustrates an in-body sheet discharge-type image forming apparatus. The image forming apparatus includes an image forming unit A, a sheet feeding unit B, a reading unit C, and a discharged sheet storage unit D. The image forming unit A is disposed at substantially the center of the image forming apparatus, and the sheet feeding unit B is disposed immediately under the image forming unit A. The image forming apparatus may include, if necessary, an extra sheet feeding unit under the sheet feeding unit B. The reading unit C for reading a document is disposed above the image forming unit A via the discharged sheet storage unit D. The discharged sheet storage unit D stores a recording sheet having an image formed thereon. A series of arrows on the right side of FIG. 14 indicate a sheet path of the recording sheet.

The image forming unit A includes drum-shaped photoconductors A1 each serving as an image carrier and surrounded by a charging device A2, a development device A3, a cleaning device A6, and a lubricant application device A7. In FIG. 14, the reference numerals are assigned only to the photoconductor A1, the charging device A2, the development device A3, the cleaning device A6, and lubricant application device A7 on the left side. The image forming unit A further includes an exposure device A10, an intermediate transfer device A4 including an intermediate transfer belt, a transfer device A5, cleaning devices A6, lubricant application devices A7, a fixing device A8, sheet discharge rollers A9, and registration rollers A11. Each of the lubricant application devices A7 includes a solid lubricant A72, a biasing member A73, and a lubricant application member A74.

The charging device A2 performs a charging process on the outer circumferential surface of the photoconductor A1. The exposure device A10 irradiates the outer circumferential surface of the photoconductor A1 with laser light based on image information to form an electrostatic latent image. The development device A3 develops and visualizes the electrostatic latent image formed on the outer circumferential surface of the photoconductor A1 by the exposure process, and thereby forms a toner image. After a later-described transfer process performed by the intermediate transfer device A4, the cleaning device A6 removes and collects toner remaining on the outer circumferential surface of the photoconductor A1. The lubricant application device A7 applies the solid lubricant A72 to the photoconductor A1 to reduce the coefficient of friction of the outer circumferential surface of the photoconductor A1. The intermediate transfer device A4 superimposes the toner images developed on the respective photoconductors A1. The transfer device A5 transfers the superimposed toner images onto the recording sheet. The fixing device A8 disposed on the downstream side of the sheet path performs a fixing process of fixing the unfixed toner images on the recording sheet. The image forming apparatus includes, as well as the cleaning devices A6 and the lubricant application devices A7 for the respective photoconductors A1, the cleaning device A6 and the lubricant application device A7 for the intermediate transfer device A4 and the transfer device A5, which are provided on the left and right sides of FIG. 14, respectively.

To make maintenance work easier, components such as the photoconductor A1, the charging device A2, the development device A3, the cleaning device A6, and the lubricant application device A7 are housed in a unit as a process cartridge PC attachable to and detachable from the body of the image forming apparatus. For the same reason, the cleaning device A6 and the lubricant application device A7 on the left side of FIG. 14 are housed in a unit attachable to and detachable from the intermediate transfer device A4. Further, the cleaning device A6 and the lubricant application device A7 on the right side of FIG. 14 and the transfer device A5 are integrally housed in a unit attachable to and detachable from the body of the image forming apparatus. The recording sheet having passed the fixing device A8 is discharged to and stored in the discharged sheet storage unit D via the sheet discharge rollers A9.

The sheet feeding unit B includes a sheet feeding cassette for storing unused recording sheets and a sheet feed roller B1. In accordance with the rotation of the sheet feed roller B1, the uppermost sheet is fed from the sheet feeding cassette and sent to the registration rollers 11. The registration rollers 11 are controlled to temporarily stop feeding the recording sheet and start rotating at appropriate timing such that the toner images on the outer circumferential surfaces of the photoconductors A1 and the leading end of the recording sheet have a predetermined positional relationship.

The reading unit C includes reading carriages C1, a contact glass C2, a lens C3, and a charge-coupled device (CCD) C4. In the reading unit C, to perform read-scanning of a not-illustrated document placed on the contact glass C2, the reading carriages C1 including a document illuminating light source and mirrors perform reciprocating movement. Image information scanned by the reading carriages C1 is read as image signals by the CCD C4 disposed behind the lens C3.

The read image signals are digitized and image-processed. On the basis of the image-processed signals, not-illustrated laser diodes of the exposure device A10 emit light to form electrostatic latent images on the respective outer circumferential surfaces of the photoconductors A1. Then, optical signals emitted from the laser diodes reach the photoconductors A1 via a known polygon mirror and lenses.

The charging device A2 mainly includes a charging member and a not-illustrated biasing member. The biasing member presses the charging member against the photoconductor A1 with predetermined pressure. The charging member includes a conductive shaft and a conductive elastic layer provided around the conductive shaft. A predetermined voltage is applied to the gap between the conductive elastic layer and the photoconductor A1 via the conductive shaft by a not-illustrated voltage application device. Thereby, the outer circumferential surface of the photoconductor A1 is charged.

The development device A3 contains a developer, and includes a development roller, a not-illustrated mixing screw, and a not-illustrated development doctor blade. The development device A3 sufficiently mixes the developer by using the mixing screw, and causes the developer to magnetically adhere to the development roller. The developer adhering to the development roller is spread into a relatively thin layer over the development roller by the development doctor blade. With the developer spread into the relatively thin layer, the electrostatic latent image on the photoconductor A1 is visualized into a toner image.

The visualized toner image is caused to electrically adhere to the intermediate transfer device A4 by a not-illustrated transfer bias roller. Residual toner having failed to be transferred to the intermediate transfer device A4 is removed from the photoconductor A1 by the cleaning device A6. The cleaning device A6 includes a cleaning blade and a not-illustrated cleaning brush roller, and is disposed upstream of the lubricant application device A7 in the rotation direction of the photoconductor A1.

In the lubricant application device A7, the lubricant application member A74 includes a metal shaft and a brush wound around the metal shaft into a roller shape. The solid lubricant A72 is biased toward the lubricant application member A74 by the biasing member A73. When rotated, the lubricant application member A74 scrapes the solid lubricant A72 into fine powder, and applies the lubricant powder to the outer circumferential surface of the photoconductor A1. In this process, a lubricant application area to be applied with the solid lubricant A72 corresponds to substantially the entire outer circumferential surface of the photoconductor A1, and is set to be larger than a cleaning area to be cleaned by the cleaning device A6. This is because, while the effective cleaning area is determined by factors such as the cleaning performance, the solid lubricant A72 is desired to be applied to the entire area of the outer circumferential surface of the photoconductor A1 in contact with the cleaning blade of the cleaning device A6.

The cleaning device A6 and the lubricant application device A7 on the left side of FIG. 14 are integrally housed in the body of the image forming apparatus, and form a transfer cartridge. The solid lubricant A72 is biased toward the lubricant application member A74 with predetermined pressure by the biasing member A73. In accordance with the rotation of the lubricant application member A74, the solid lubricant A72 is scraped off and applied to the outer circumferential surface of the intermediate transfer device A4. The cleaning device A6 including a cleaning blade and a not-illustrated cleaning brush roller is located downstream of the lubricant application device A7 in the rotation direction of the intermediate transfer device A4. The cleaning brush roller rotates in the same direction as the rotation direction of the intermediate transfer device A4, and disperses foreign substances on the outer circumferential surface of the intermediate transfer device A4. The cleaning blade, which is in contact with the intermediate transfer device A4 at a predetermined angle with predetermined pressure, removes residual toner on the intermediate transfer device A4.

The cleaning device A6 and the lubricant application device A7 on the right side of FIG. 14 and the transfer device A5 are integrally housed in the body of the image forming apparatus, and form a transfer cartridge. The cleaning device A6 is disposed as illustrated in FIG. 14 to remove residual toner on the transfer device A5.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A fixing device which fixes a toner image on a recording medium by heating the recording medium, with a heating area and a non-heating area selected in accordance with a magnetic flux and a repulsive magnetic flux, the heating area having a boundary with the non-heating area, the fixing device comprising:

a heat generating layer configured to generate heat;

an exciting coil configured to generate the magnetic flux and thereby inductively heat the heat generating layer; and a demagnetizing member facing the heat generating layer in the non-heating area and configured to:

generate the repulsive magnetic flux against the magnetic flux generated by the exciting coil and thereby demagnetize the magnetic flux and decrease a generation of heat in one of a portion of the non-heating area adjacent to a portion of the non-heating area adjacent to the boundary and a portion of the heating area adjacent to a portion of the heating area adjacent to the boundary, and have a different demagnetization effect between at least the portion of the non-heating area adjacent to the boundary and a remaining portion of the non-heating area, wherein a first portion of the demagnetizing member is located closer to the exciting coil along a direction the demagnetizing member faces the exciting coil in the portion of the non-heating area adjacent to the boundary than a second portion of the demagnetizing member in the remaining portion of the non-heating area.

2. The fixing device according to claim 1, wherein the demagnetizing member comprises a cancellation coil that faces the exciting coil and generates a magnetic flux in a direction of canceling the magnetic flux of the exciting coil.

3. The fixing device according to claim 2, wherein the demagnetizing member has an end portion located at a position of the boundary of the heating area with the non-heating area.

4. The fixing device according to claim 1, wherein the demagnetizing member comprises a metal plate having a portion of increased thickness in the portion of the non-heating area adjacent to the boundary.

5. The fixing device according to claim 1, wherein the demagnetizing member comprises a metal plate having a portion of enlarged area in an area facing the exciting coil.

6. The fixing device according to claim 1, wherein the demagnetizing member comprises a metal plate having portions of different electrical resistances.

7. The fixing device according to claim 6, wherein the metal plate forming the demagnetizing member has a portion plated with a material having low electrical resistance.

8. The fixing device according to claim 1, wherein the demagnetizing member comprises a metal plate provided with one of a hole and a groove in the non-heating area.

9. The fixing device according to claim 1, wherein the demagnetizing member comprises a metal plate having a portion located adjacent to the exciting coil.

10. The fixing device according to claim 1, wherein the demagnetizing member comprises an aluminum plate.

11. An image forming apparatus comprising:

an image forming unit configured to form a toner image on a recording medium; and a fixing device according to claim 1, configured to have the heat generating layer provided in a fixing roller.

12. A fixing device which fixes a toner image on a recording medium by heating the recording medium, with a heating area and a non-heating area selected in accordance with a magnetic flux and a repulsive magnetic flux, the heating area having a boundary with the non-heating area, the fixing device comprising:

a heat generating layer configured to generate heat;

an exciting coil configured to generate the magnetic flux and thereby inductively heat the heat generating layer; and a demagnetizing member facing the heat generating layer in the non-heating area and configured to:

generate the repulsive magnetic flux against the magnetic flux generated by the exciting coil and thereby demagnetize the magnetic flux and decrease a generation of heat in one of a portion of the non-heating area adjacent to a portion of the non-heating area adjacent to the boundary and a portion of the heating area adjacent to a portion of the heating area adjacent to the boundary, and have a different demagnetization effect between at least the portion of the non-heating area adjacent to the boundary and a remaining portion of the non-heating area, wherein the demagnetizing member comprises a cancellation coil that faces the exciting coil and generates a magnetic flux in a direction of canceling the magnetic flux of the exciting coil, and wherein the cancellation coil is located closer to the exciting coil along a direction the cancellation coil faces the exciting coil in the portion of the non-heating area adjacent to the boundary than in the remaining portion of the non-heating area.

13. A fixing device which fixes a toner image on a recording medium by heating the recording medium, with a heating area and a non-heating area selected in accordance with a magnetic flux and a repulsive magnetic flux, the heating area having a boundary with the non-heating area, the fixing device comprising:

a heat generating layer configured to generate heat;

an exciting coil configured to generate the magnetic flux and thereby inductively heat the heat generating layer; and a demagnetizing member facing the heat generating layer in the non-heating area and configured to:

generate the repulsive magnetic flux against the magnetic flux generated by the exciting coil and thereby demagnetize the magnetic flux and decrease a generation of heat in one of a portion of the non-heating area adjacent to a portion of the non-heating area adjacent to the boundary and a portion of the heating area adjacent to a portion of the heating area adjacent to the boundary, and have a different demagnetization effect between at least the portion of the non-heating area adjacent to the boundary and a remaining portion of the non-heating area, wherein the demagnetizing member includes a metal plate having one of a portion of increased thickness in the portion of the non-heating area adjacent to the boundary, a portion of enlarged area in an area facing the exciting coil, and one of a hole and a groove in the non-heating area.

* * * * *